US005185772A

United States Patent [19]

Shirouzu et al.

[11] Patent Number: 5,185,772

[45] Date of Patent: Feb. 9, 1993

[54] RADIATION PICKUP DEVICE, AND RADIATION IMAGING SYSTEM AND METHOD FOR THE SAME

[75] Inventors: Shunji Shirouzu, Ayase; Tamotsu Hatayama, Yamato; Shouichi Inoue, Kawasaki, all of Japan

[73] Assignee: Kabushiki Kaisha Toshiba, Kawasaki, Japan

[21] Appl. No.: 751,108

[22] Filed: Aug. 28, 1991

[30] Foreign Application Priority Data

Aug. 29, 1990 [JP] Japan ..... 2-229218

[51] Int. Cl.[5] ..... G03G 13/044

[52] U.S. Cl. ..... 378/29; 378/28; 378/32

[58] Field of Search ..... 378/28, 29, 31, 32

[56] References Cited

U.S. PATENT DOCUMENTS 3,922,523 11/1975 Sheldon ..... 378/28
4,121,101 10/1978 Matsumoto ..... 378/32
4,598,207 8/1983 Naruse et al. .

*Primary Examiner*—Craig E. Church
*Attorney, Agent, or Firm*—Oblon, Spivak, McClelland, Maier & Neustadt

[57] ABSTRACT

An imaging belt, a dielectric recording sheet, a charger, a transcript roller, and first and second rollers are arranged in a casing. A latent image corresponding to a radiation transmitted image is formed on the imaging belt. At least a fluorescent layer which is sensitive to a radiation to emit light, and a photosensitive layer sensitive to the light emitted by the fluorescent layer are formed on a flexible substrate to constitute the imaging belt. The imaging belt is looped around the first and second rollers, and is driven to rotate. The dielectric recording sheet is rolled, and the latent image formed on the photosensitive layer of the imaging belt is transcribed onto the dielectric recording sheet. The charger charges the surface of the imaging belt at a high voltage. The transcript roller urges the dielectric recording sheet against the imaging belt. Then, the latent image formed on the imaging belt is transcribed onto the dielectric recording sheet.

28 Claims, 16 Drawing Sheets

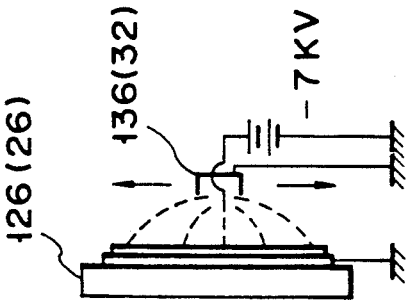
FIG. 13A
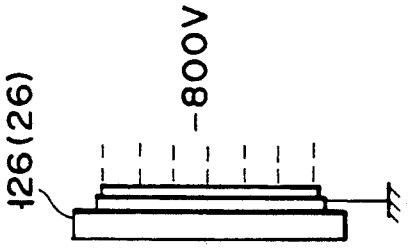
FIG. 13B
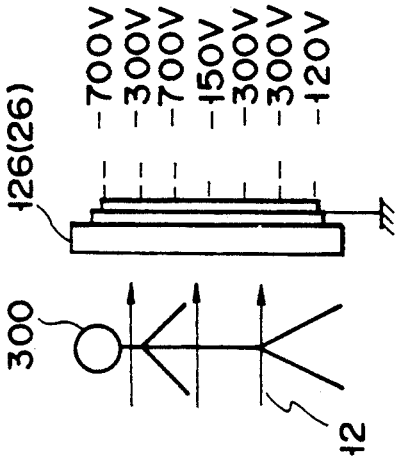
FIG. 13C
FIG. 13D
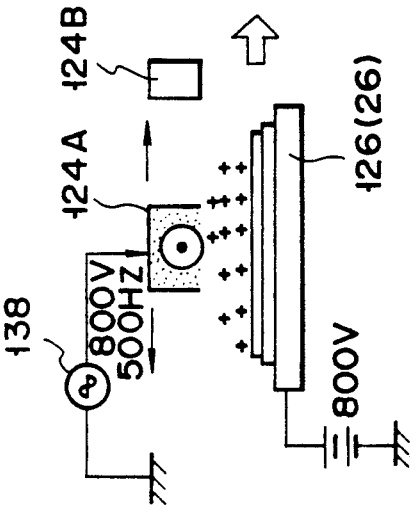
FIG. 13E
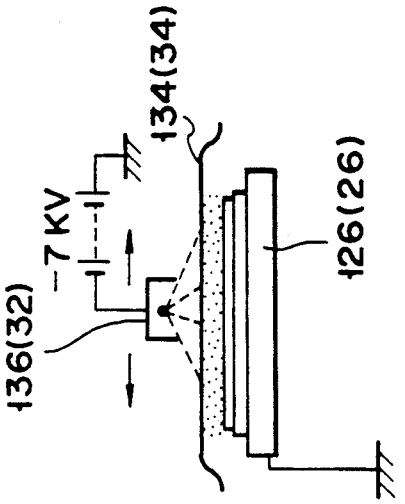
FIG. 13F

RADIATION PICKUP DEVICE, AND RADIATION IMAGING SYSTEM AND METHOD FOR THE SAME

BACKGROUND OF THE INVENTION

1. Field of the Invention

The present invention relates to a radiation pickup device for obtaining a life-size radiation transmitted image (radiographic image, fluoroscopic image) of a large subject, and a radiation imaging system and a method for the same.

2. Description of the Related Art

An imaging technique using a radiation such as X-rays is one of the significant techniques in various industrial fields including the medical field.

Such a radiation imaging technique must satisfy necessary conditions specific to the field to which it is applied. For example, in X-ray imaging in the medical field, the conditions are: the X-ray dose must be minimized, a large radiographic area must be secured, a high resolution must be obtained, and a wide dynamic range must be obtained. As an X-ray is an invisible beam, some optical lenses cannot reduce or enlarge an X-ray transmitted image. For this reason, various methods for obtaining an X-ray transmitted image in the form of electrical signals directly from a life-size image storage medium recording an X-ray image have been conventionally proposed and practiced.

The first method is as follows. An X-ray image obtained by X-ray transmission through a subject is converted to a visible image by using a fluorescent intensifying screen. A photographic film is brought into tight contact with the fluorescent intensifying screen so that the visible image is transcribed to the film by a photographing phenomenon. The film is then irradiated with a flat beam from one direction. A lens and a photomultiplier are arranged on a side of the film opposite to the side irradiated with the flat beam. The image on the film is X-Y scanned by the lens and the photomultiplier. As a result, the image on the film is derived as time-serial electrical signals.

With this method, a high resolution of, e.g., 6 to 10 l p/mm can be obtained. However, in order to sufficiently photograph a high-sensitivity photographic film, the dose of the X-rays must be sufficiently increased as high as, e.g., about several 100 mrhm to 1 rmh. As the photographic density of a film is not linearly proportional to the incident X-ray dose, complex processing is required for an image signal obtained by the photomultiplier. The photographic density of a photographic film has a dynamic range of about 60 dB. Although an X-ray transmitted image on a photographic film can be picked up by a television camera, a high resolution cannot be obtained in this case unlike in the case of life-size processing.

According to the second method, an image storage medium, e.g., an imaging plate, in which a photosensitive layer, e.g., an amorphous Si material, is formed on a substrate, e.g., an Al plate, is used. The entire surface of such an imaging plate is uniformly charged to, e.g., about 500 V by using a high-voltage charger. An X-ray beam is radiated on the imaging plate from its rear surface. Then, a potential pattern corresponding to the radiation transmittance of the subject is formed on the imaging plate. The potential pattern forms a latent image. The latent image on the image plate is mechanically X-Y scanned by the probe of an electrostatic potentiometer, and surface potential signals are obtained as electrical signals in a non-contact manner.

With this method, a wide dynamic range can be obtained in principle while ensuring a high resolution. Therefore, the X-ray dose can be reduced compared to the case of the first method. However, the second method has the following drawbacks. Assume that an X-ray image of a human body is to be obtained as an example of a life-size image. In this case, about a 40 cm×40 cm-sized imaging plate is needed. In order to mechanically X-Y scan such a big imaging plate with a potential difference measurement device to read a latent image, several to several tens of seconds are required. For example, in order to obtain a resolution of 6 to 10 l p/mm, about 4,000 scanning lines are required both in the X- and Y-axis directions, as in a television receiver, and sub-scanning takes an especially long period of time. However, a latent image formed on an imaging plate by an X-ray transmitted image is attenuated in several seconds. As a result, the image potential of a non-scanned portion is largely decreased before scanning is completed, resulting in a large non-uniformity in image quality in the vertical direction on the monitor screen.

SUMMARY OF THE INVENTION

It is, therefore, an object of the present invention to provide a radiation pickup device for radiation imaging capable of obtaining a radiation transmitted image having a uniform image quality and capable of continuous imaging.

It is another object of the present invention to provide a radiation imaging system capable of obtaining a radiation transmitted image having a uniform image quality and capable of continuous imaging.

It is still another object of the present invention to provide a radiation imaging method for easily obtaining a hard copy of a radiation transmitted image having a good gradation characteristic.

The above objects are achieved by a radiation pickup device for radiation imaging, which comprises:

a casing having a radiation incident window formed therein;

first and second rollers arranged in the casing on two sides of the radiation incident window, respectively;

an endless belt-like imaging belt, which is obtained by forming a fluorescent layer, that is sensitive to a radiation to emit light, and a photosensitive layer sensitive to light emitted by the fluorescent layer, on a flexible substrate, and which is looped around the first and second rollers to be driven thereby, for forming a latent image corresponding to a radiation transmitted image;

a charger, arranged in the casing on the first roller side, for uniformly charging the photosensitive layer of the imaging belt;

a rolled dielectric recording sheet, removably arranged in the casing, for transcribing the latent image formed on the photosensitive layer of the imaging belt;

a transcript roller which presses an extracted portion of the dielectric recording sheet against the second roller together with the imaging belt, thereby transcribing the latent image formed on the imaging belt onto the dielectric recording sheet; and a takeup roller for taking up a portion of the dielectric recording sheet on which the latent image is transcribed by being passed between the transcript roller and the second roller.

The above objects are also achieved by a radiation imaging system including:

a radiation pickup device comprising a casing having a radiation incident window formed therein, first and second rollers arranged in the casing on two sides of the radiation incident window, respectively, an endless belt-like imaging belt, which is obtained by forming a fluorescent layer, that is sensitive to a radiation to emit light, and a photosensitive layer sensitive to light emitted by the fluorescent layer, on a flexible substrate, and which is looped around the first and second rollers to be driven thereby, for forming a latent image corresponding to a radiation transmitted image, a charger, arranged in the casing on the first roller side, for uniformly charging the photosensitive layer of the imaging belt, a rolled dielectric recording sheet, removably arranged in the casing, for transcribing the latent image formed on the photosensitive layer of the imaging belt, a transcript roller which presses an extracted portion of the dielectric recording sheet against the second roller together with the imaging belt, thereby transcribing the latent image formed on the imaging belt onto the dielectric recording sheet, and a takeup roller for taking up a portion of the dielectric recording sheet on which the latent image is transcribed by being passed between the transcript roller and the second roller; and image reading mean for scanning the latent image on the dielectric recording sheet by a probe while rewinding the dielectric recording sheet, taken up by the takeup roller, to another takeup roller, converting the latent image into an electrical signal, and reading the electrical signal.

The above objects are also achieved by a radiation imaging system including:

a radiation pickup device comprising;

a casing having a radiation incident window formed therein, first and second rollers arranged in the casing on two sides of the radiation incident window, respectively, an endless belt-like imaging belt, which is obtained by forming a fluorescent layer, that is sensitive to a radiation to emit light, and a photosensitive layer sensitive to light emitted by the fluorescent layer, on a flexible substrate, and which is looped around the first and second rollers to be driven thereby, for forming a latent image corresponding to a radiation transmitted image, a charger, arranged in the casing on said first roller side, for uniformly charging the photosensitive layer of said imaging belt, a rolled dielectric recording sheet, removably arranged in the casing, for transcribing the latent image formed on the photosensitive layer of the imaging belt, a transcript roller which presses an extracted portion of the dielectric recording sheet against the second roller together with the imaging belt, thereby transcribing the latent image formed on the imaging belt onto the dielectric recording sheet, and a takeup roller for taking up a portion of said dielectric recording sheet on which the latent image is transcribed by being passed between the transcript roller and said second roller;

image reading means for scanning the latent image on the dielectric recording sheet by a probe while rewinding the dielectric recording sheet, taken up by the takeup roller, to another takeup roller, converting the latent image into an electrical signal, and reading the electrical signal; and developing means for developing the latent image on the dielectric recording sheet with a coloring developing agent.

The above objects are also achieved by a radiation imaging method for obtaining a hard copy of a radiation transmitted image by using an image storage medium, the image storage medium being employed to form the latent image corresponding to the radiation transmitted image and being obtained by forming at least a fluorescent layer which is sensitive to a radiation to emit light, and a photosensitive layer sensitive to the light emitted by the fluorescent layer, on a flexible substrate, the method comprising the steps of:

charging a front surface of the image storage medium, to which the radiation transmitted image reaches, with a high voltage;

radiating the radiation transmitted image onto the front surface of the image storage medium in order to form the latent image thereon;

scanning the front surface of the image storage medium, on which the latent image is formed, with a toner developing unit to which an AC voltage is supplied; and scanning the front surface of the image storage medium with a charger by a high voltage, thereby reversely transcribing a toner image formed on the front surface of the image storage medium onto a sheet member.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 13A to 13F are views showing a system and a method of easily obtaining a hard copy of a radiation transmitted image having a good gradation characteristic;

DETAILED DESCRIPTION OF THE PREFERRED EMBODIMENTS

The preferred embodiments of the present invention will be described with reference to the accompanying drawings.

Figure 1:
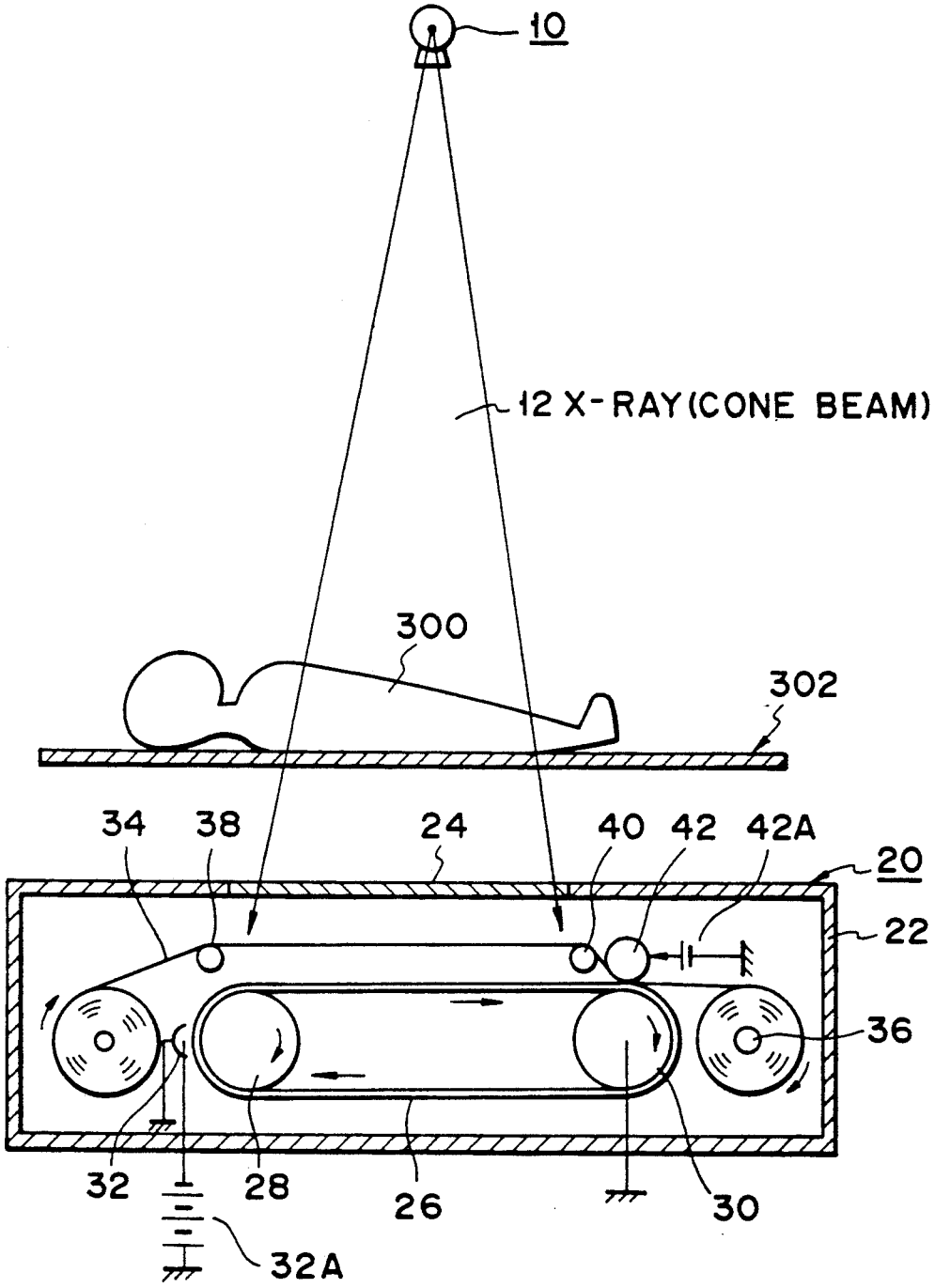
FIG. 1 is a schematic diagram of a radiation pickup device for radiation imaging and a radiation photographing apparatus as a radiation imaging system according to an embodiment of the present invention.

FIG. 1 discloses a radiation photographing apparatus as a radiation imaging system using a radiation pickup device according to the present invention. This radiation photographing apparatus can obtain a radiographic image and a fluoroscopic image as a radiation transmitted image. An X-ray is used as the radiation. The X-rays are formed to have a predetermined shape, e.g., a cone shape or a fan shape, by a device such as a limiting device provided to the X-ray tube.

The radiation photographing apparatus according to the present invention comprises a radiation generating means, a radiation detecting means, an image processing means, an image display means, and a subject holding means. FIG. 1 discloses the radiation generating means, the radiation detecting means, and the subject holding means, of which the radiation detecting means is disclosed particularly in detail. The image processing means and the image display means, that are not disclosed, can be replaced by those of a conventional radiation photographing apparatus, and a detailed description thereof is omitted. When the dielectric recording sheet of the apparatus shown in FIG. 1 is supplied to the potential difference measurement device shown in FIG. 4, the potential difference measurement device presents a radiation transmitted image in the form of electrical signals. The radiation transmitted image in the form of electrical signals may be appropriately image-processed by a known image processing means and may be displayed by a known image display means.

An X-ray source 10 shown in FIG. 1 is one of the elements that constitute the radiation generating means. A radiation pickup device 20 is one of the elements that constitute the radiation detecting means. A tabletop 302 holding a subject 300 is one of the elements that constitute the subject holding means. The X-ray source 10 and the radiation pickup device 20 are arranged to sandwich the tabletop 302. An X-ray beam 12 radiated by the X-ray source 10 is transmitted through the subject 300 and reaches the radiation pickup device 20. The radiation pickup device 20 picks up an X-ray transmitted image.

The radiation pickup device 20 will be described in detail. The radiation pickup device 20 has a box-like casing 22. An X-ray incident window member 24 made of an X-ray transmitting material is arranged at the front surface of the casing 22. An imaging belt 26 is arranged in the casing 22. The imaging belt 26 can pick up the X-ray transmitted image and form a latent image. First and second rollers 28 and 30 having axes parallel to the X-ray incident window 24 are arranged in the casing 22. The second roller 30 is grounded. The imaging belt 26 is looped around the first and second rollers 28 and 30. The detailed structure of the imaging belt 26 will be described later.

A charger 32 is provided close to the first roller 28 with a small gap of about 5 mm to the imaging belt 26. A negative potential is applied to the charger 32 by a power supply 32A. The charger 32 can uniformly charge the surface of the imaging belt 26 at a negative potential. A rolled dielectric recording sheet 34 is stored in the casing 22 on the outer side of the first roller 28.

A takeup roller 36 is arranged in the casing 22 on the outer side of the second roller 30. The recording sheet 34 is extracted and taken up by the takeup roller 36 through guide rollers 38 and 40. A transcript roller 42 is provided in the vicinity of the second roller 30 to oppose it.

A positive offset voltage is applied to the transcript roller 42 when necessary by a power supply 42A. The imaging belt 26 and the recording sheet 34 are sandwiched between the transcript roller 42 and the second roller 30 to be urged and pressed against each other. Then, a latent image formed on the imaging belt 26 is transcribed onto the recording sheet 34. The recording sheet 34 is then taken up by the takeup roller 36.

Figure 2:
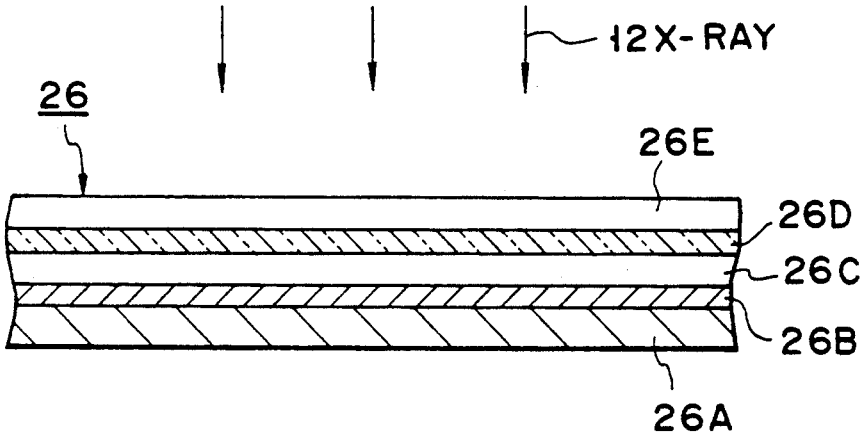
FIG. 2 is a sectional view of an imaging belt incorporated in the radiation pickup device according to the present invention.

The structure of the imaging belt 26 used in the present invention can be understood from FIG. 2 showing its enlarged sectional view. More specifically, the imaging belt 26 is obtained by sequentially forming a light-reflecting layer 26B, a fluorescent layer 26C, a transparent conductive film 26D, and a photosensitive layer 26E on a flexible substrate 26A, e.g., a plastic plate.

The fluorescent layer 26C contains an element such as gadolinium, iodine, and cesium. A typical example of the fluorescent layer 26C is a $Gd_2O_2Si$:Tb layer having a thickness of about 200 μm. Upon incidence of an X-ray beam, the fluorescent layer 26C using gadolinium exhibits light emission having a peak at a wavelength of 550 nm. Accordingly, the fluorescent layer 26C using gadolinium has a very high light-emitting efficiency. The photosensitive layer 26E is made of an inorganic or organic photosensitive material. A typical example of the photosensitive layer 26E is an amorphous Si layer having a thickness of about 20 μm. The amorphous Si layer (photosensitive layer 26E) has a high sensitivity in a visible range and exhibits a quantization efficiency of about 100% with respect to a light beam having a wavelength of about 50 mm.

An arrangement of a means for reading a latent image (charge image) from the recording sheet 34 will be described with reference to a typical surface potential measurement device shown in FIGS. 3 and 4. This device basically corresponds to a device according to a patent application (Japanese Patent Application No. 1-111616) which was previously filed in the Japanese Patent Office by the present inventors and is published in an official gazette.

Figure 3:
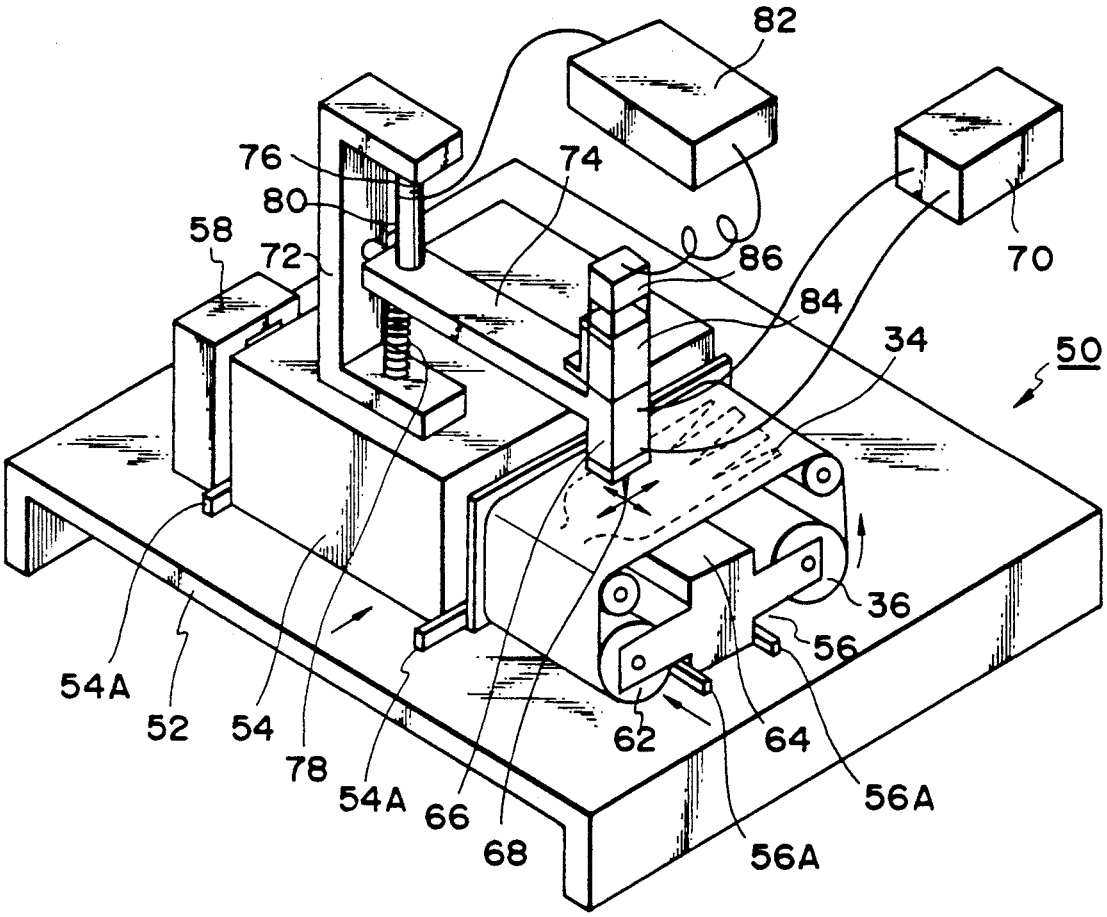
FIG. 3 is a perspective view of an arrangement of a potential difference measurement device.
Figure 4:
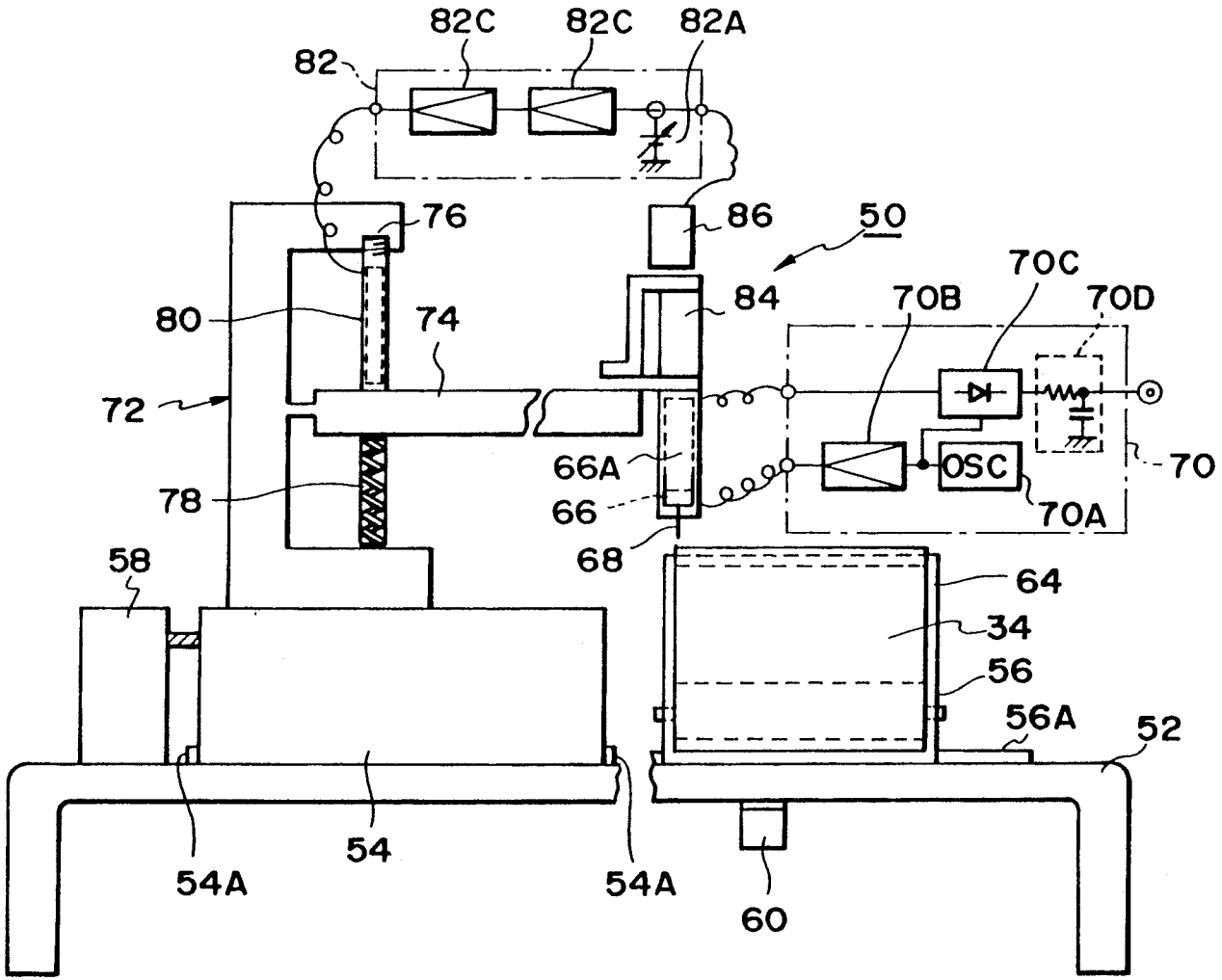
FIG. 4 is a front view of the potential difference measurement device shown in FIG. 3.

In the surface potential measurement device 50 shown in FIGS. 3 and 4, the recording sheet 34 extracted from the casing 22 is set, and a vibration type probe 68 scans the recording sheet 34 in the X- and Y-axis directions. More specifically, an X-axis table 54 and a Y-axis table 56 are arranged on a stage 52. The X-axis table 54 is movable along X-axis guides 54A provided on the stage 52. The Y-axis table 56 is movable along Y-axis guides 56A provided on the stage 52. The X- and Y-axis tables 54 and 56 are driven by X- and Y-axis drive motors 58 and 60, respectively.

When the recording sheet 34 is taken up after a latent image (charge image) is formed on it, it is extracted by a rewind mechanism 62 formed on the Y-axis table 56 in units of frames. The extracted portion of the recording sheet 34 corresponding to one frame is set above a scanning stage 64 integrally formed with the Y-axis table 56. The charge image on the set recording sheet 34 is sequentially picked up by the probe 68. The probe 68 is slightly vibrated by a vibration piezo-element 66. For this purpose, the vibration piezo-element 66 is connected to a top amplifier 66A. The charge image obtained by being sequentially picked up by the probe 68 is derived by a surface potential detection circuit 70 as image signals.

The surface potential detection circuit 70 comprises a reference signal oscillator 70A, a high-voltage amplifier 70B, a sync detection circuit 70C, and an integrating circuit 70D. A gap control mechanism 72 is provided on the X-axis table 54. The vibration piezo-element 66 is mounted on the distal end of an arm 74 of the gap control mechanism 72.

The gap control mechanism 72 has a gap adjusting screw 76, a balancing spring 78, and a piezo-element 80 for driving the gap control mechanism 72. The piezo-element 80 is controlled by a gap control circuit 82. The gap control circuit 82 comprises a variable power supply 82A, an error amplifier 82B, and a high-voltage amplifier 82C. Gap control allows the distal end portion of the probe 68, mounted on the distal end of the arm 74, to be automatically kept at a predetermined gap with respect to the recording sheet 34.

For the purpose of gap control, a gap position detecting optical system 84 and a gap position detection circuit 86 are provided to be coaxial with the probe 68. More specifically, a light beam is radiated by the optical system 84 onto the recording sheet 34. Upon detection of the beam reflected by the recording sheet 34, a gap is detected by the position detection circuit 86 and is fed back to the piezo-element 80 by the gap control circuit 82.

Figure 5:
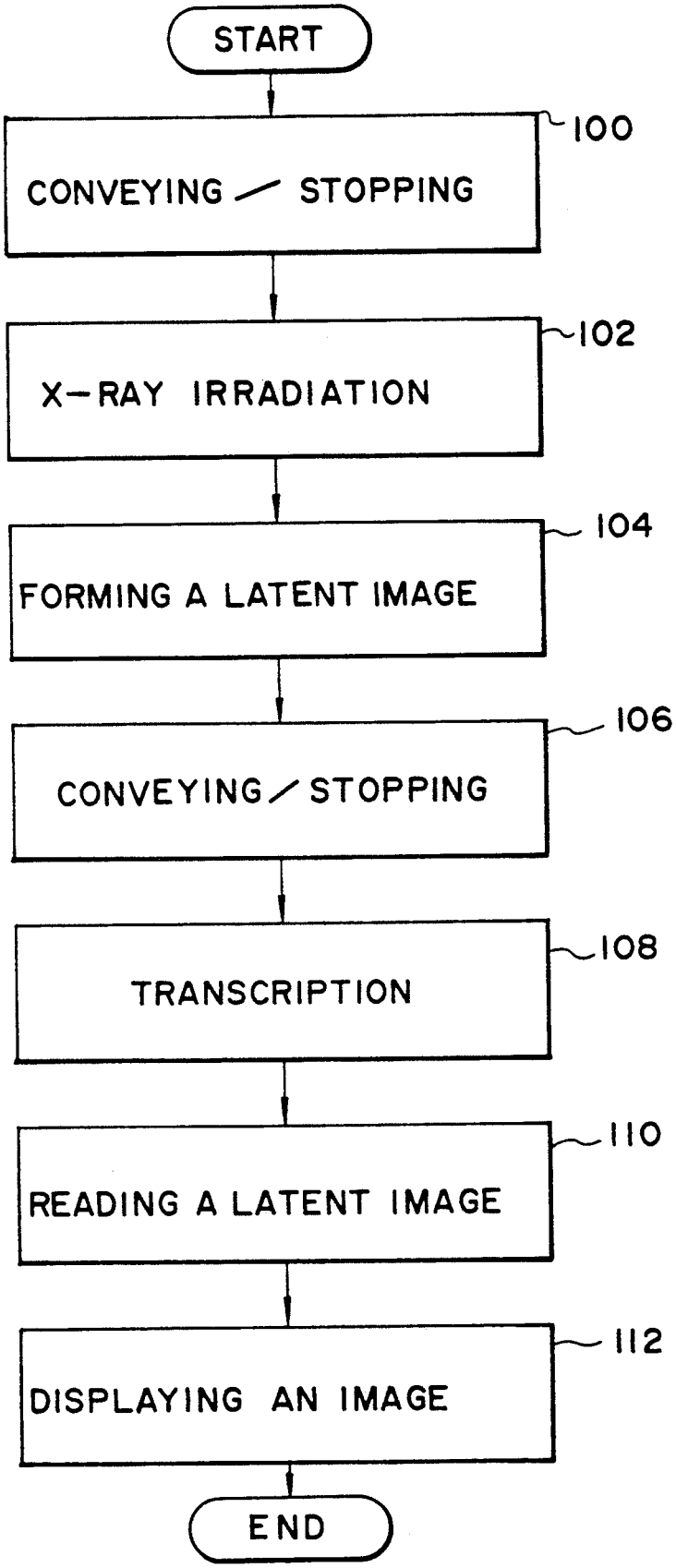
FIG. 5 is a flow chart of radiation imaging by using the system shown in FIG. 1.

An image pickup operation by the device shown in FIG. 1 and an image reading operation by the device shown in FIGS. 3 and 4 will be described with reference to FIG. 5. First, the imaging belt 26 is initialized. More specifically, while the imaging belt 26 is being driven in synchronism with the dielectric recording sheet 34, a high voltage of about 4 to 7 kV is applied to it by the charger 32 on the first roller 28 side. A portion of the recording sheet 34 corresponding to a single image pickup is uniformly charged to about, e.g., −600 V by this high voltage. When the charged portion of the imaging belt 26 reaches the X-ray incident window member 24 of the casing 22, the imaging belt 26 is temporarily stopped (step 100).

The X-ray beam 12 is radiated by the X-ray source 10 (step 102). The X-ray beam 12 is transmitted through the subject 300 and reaches the radiation pickup device 20. The radiation pickup device 20 picks up an X-ray transmitted image. More specifically, the X-ray transmitted image enters the casing 22 through the X-ray incident window member 24, is transmitted through the recording sheet 34, and reaches the imaging belt 26. The X-ray irradiation condition is 70 keV and about 1 mR when, e.g., a fluoroscopic image of a human body is to be obtained.

A latent image is formed on the imaging belt 26 by X-ray irradiation (step 104). More specifically, upon being irradiated with the X-ray beam, the fluorescent layer 26C emits visible light, and the charges on the portions of the photosensitive layer 26E irradiated with the visible light are discharged in accordance with the individual light emission amounts. Accordingly, a potential pattern of 500 V to 50 V is formed in accordance with the X-ray transmitted image. This X-ray irradiation is performed during, e.g., 1 sec. During X-ray irradiation, the imaging belt 26 and the recording sheet 34 are kept stopped When X-ray irradiation is completed, the imaging belt 26 and the recording sheet 34 are driven again (step 106). The potential pattern formed on the imaging belt 26 is transcribed onto a portion of the recording sheet 34 sandwiched between the transcript roller 42 and the second roller 30 in a tight-contact manner or an press-manner (step 108). An offset voltage is applied to the transcript roller 42 as necessary in order to facilitate transcription.

The recording sheet 34 is taken up by the takeup roller 36 as it is being subjected to tight contact transcription. When a portion of the recording sheet 34 corresponding to a single image pickup is taken up, the imaging belt 26 is newly charged and advances for an amount corresponding to a subsequent image pickup portion. The imaging belt 26 is then stopped again, and preparation for X-ray irradiation is completed. Then, image pickup, transcription, and takeup are repeated in the same manner.

In this embodiment, continuous image pickup and recording of an X-ray transmitted image are possible until the recording sheet 34 housed in the casing 22 runs out. The retain time of a charge image transcribed onto the recording sheet 34 differs depending on the dielectric material to be used. A charge image can be retained on the recording sheet 34 for at least several days.

According to the present invention, a plurality of frames of X-ray transmitted images can be continuously obtained. Therefore, the obtained X-ray transmitted images can be used as an information source for obtaining a tomographic image or stereoscopic transmitted image of a subject. A tomographic image of a subject can be obtained by a system shown in FIG. 7, as will be described later. A stereoscopic transmitted image can be obtained by using a stereo X ray tube as the X ray source.

According to this embodiment, the recording sheet 34 is extracted from the casing 22 when it is taken up after repetitive image pickup and transcription. Then, signal reproduction is performed by the device shown in FIGS. 3 and 4 (step 110). As the transcribed image is retained for several days, as described before, it can be reproduced at a place remote from the place it is photographed.

With the surface potential measurement device 50, the average gap between the probe 68 and the recording sheet 34 is automatically precisely controlled as the probe 68 is slightly vibrated, and the latent images formed on the recording sheet 34 are sequentially read one frame by X-Y scanning. Readout electrical signals can be sequentially processed, or can be temporarily stored in a separate electronic memory and subjected to signal processing, e.g., digital subtraction. After signal processing, a transmitted image is displayed (step 112).

As has been described above, according to this embodiment, a large number of life-size X-ray transmitted images can be continuously obtained as charge images during a short period of time. Therefore, a vertical tomographic image or a stereoscopic transmitted image can be easily obtained. When an image picked up and stored in the photosensitive layer as the latent image is to be read, the latent image is temporarily recorded onto the dielectric recording sheet by transcription in a tight-contact manner. Therefore, reading without attenuation in image potential is enabled, and a uniform reproduced image can thus be obtained.

Figure 6:
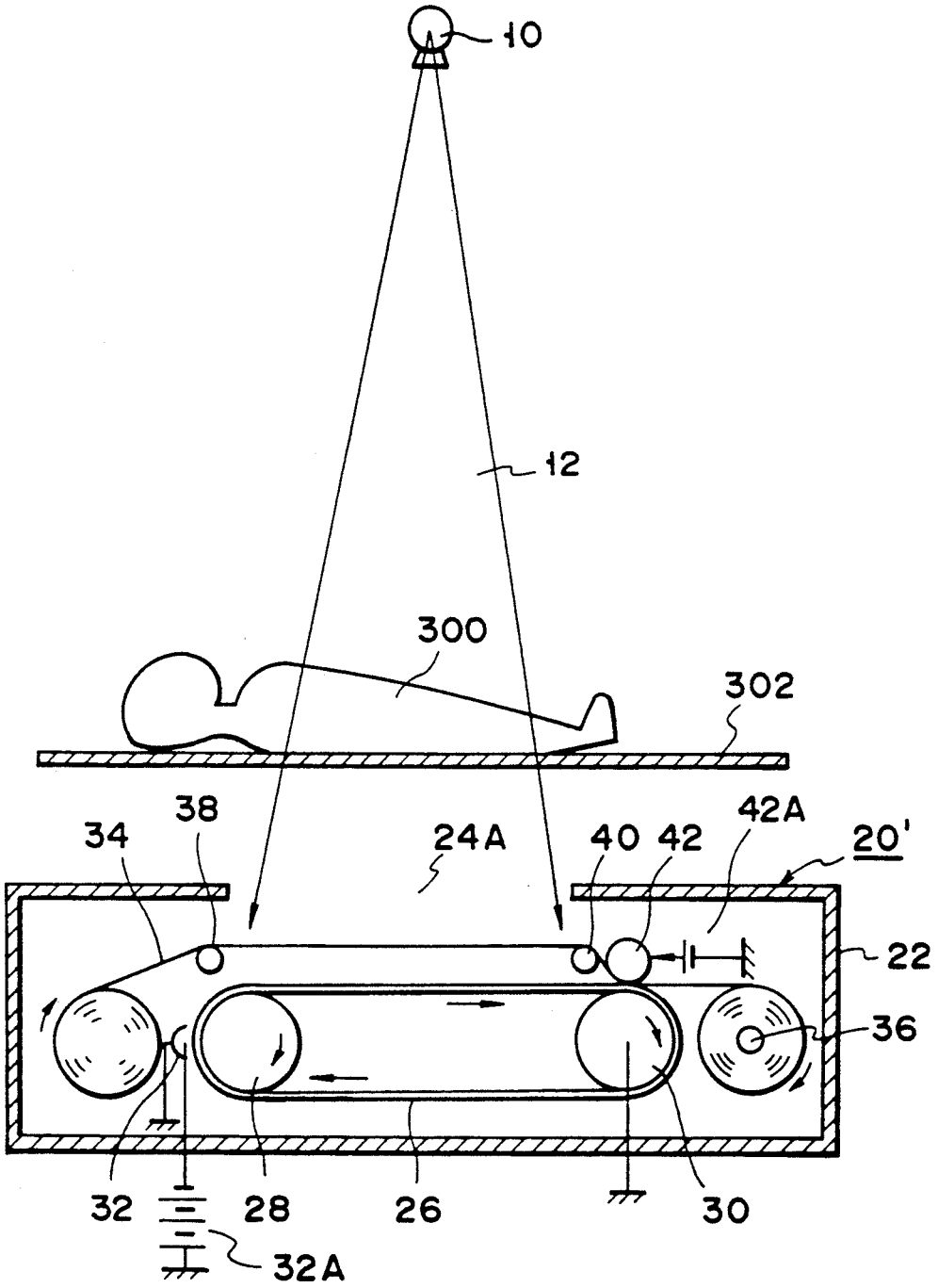
FIG. 6 is a schematic view of a modification of the radiation pickup device shown in FIG. 1, in which a radiation incident window is not formed with an X-ray transmitting member but with a hole.
Figure 7:
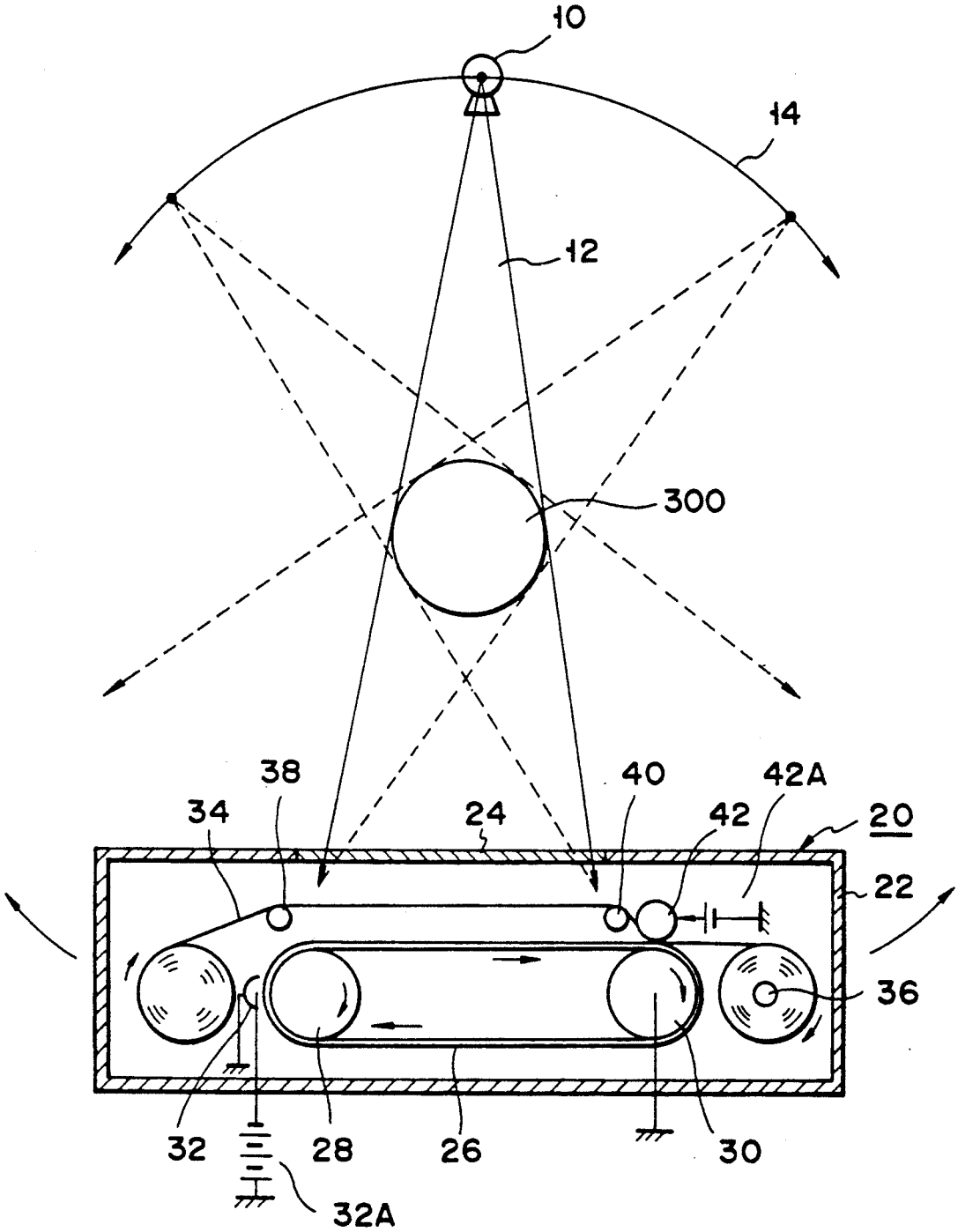
FIG. 7 is a schematic view of an embodiment of a computed tomographic scanner (CT scanner) as a radiation imaging system using the radiation pickup device shown in FIG. 1.

In this embodiment, the X-ray transmitted image is obtained by X-ray radiation on the upper surface side of the imaging belt 26. However, X-ray radiation can be performed on the substrate side of the imaging belt 26. FIG. 6 shows a modification of the radiation pickup device 20 shown in FIG. 1. As shown in FIG. 6, a radiation incident window need not be formed with an X-ray transmitting material. In FIG. 6, a radiation pickup device 20' has a hole 24A as the radiation incident window. Furthermore, the radiation pickup device 20 shown in FIG. 1 can be used to constitute a rotate-rotate type CT scanner system, as shown in FIG. 7. As shown in FIG. 7, the subject 300 is placed between an X-ray source 10 and a radiation pickup device 20. The X-ray source 10 is moved along a rotation path 14 while it emits an X-ray beam having a predetermined shape, e.g., a cone shape or a fan shape. Simultaneously, the radiation pickup device 20 is also moved along a rotation path 21.

Figure 8:
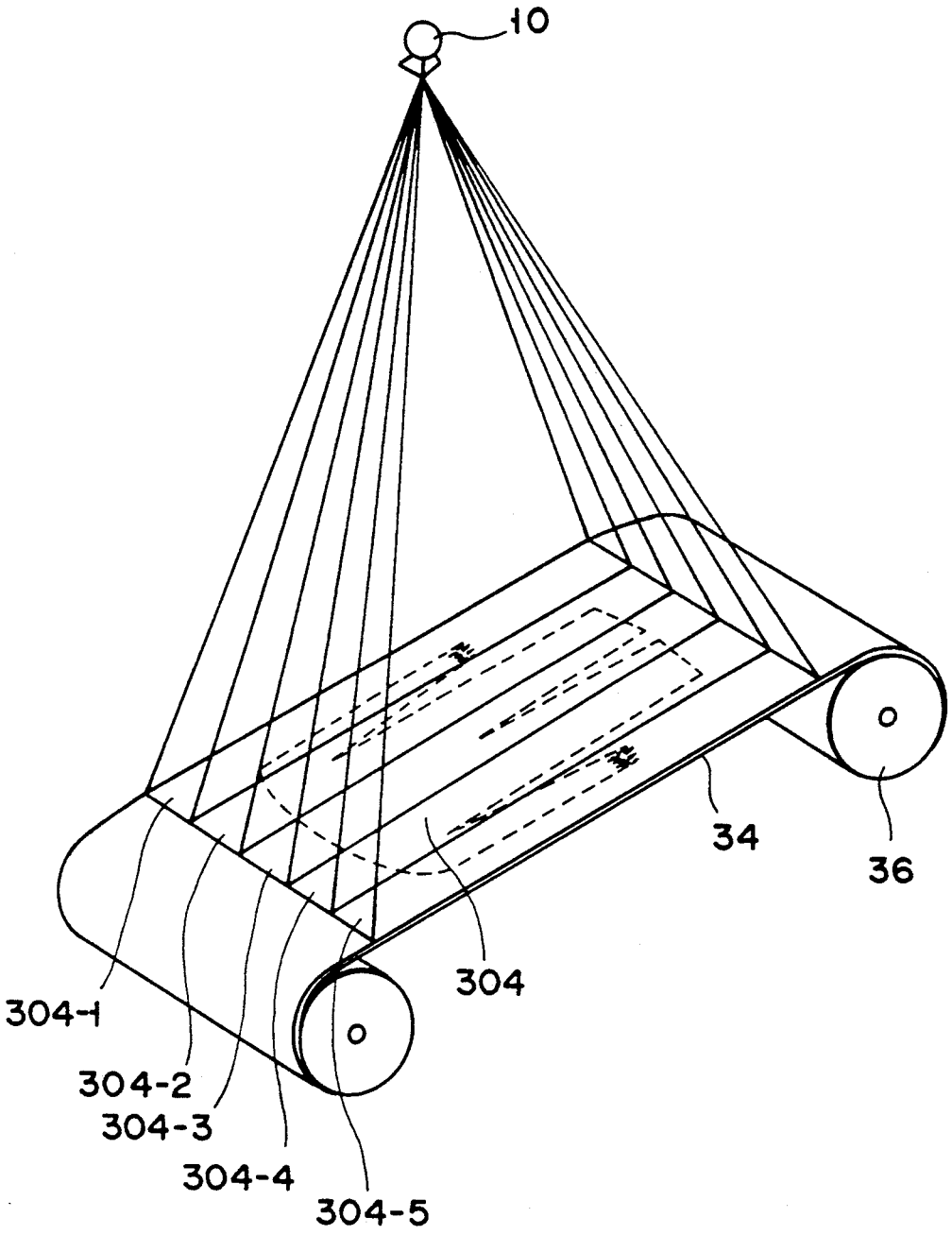
FIG. 8 is a perspective view showing the relationship among a cone beam, an imaging belt, and a latent image of the system shown in FIG. 7.

With the above operations, when a cone-shaped X-ray beam is radiated, latent images 304 (304-1, 304-2, 304-3, 304 4, 304-5) corresponding to a plurality of slices are formed at once on the recording sheet 34, as shown in FIG. 8. With a conventional X ray detector, X-ray transmitted image data of only a singles slice can be obtained by a single scanning. In contrast to this, in the embodiment of FIG. 7, transmitted image data corresponding to a plurality of slices can be obtained at once. Thus, the X-ray utilization efficiency is improved. Also, since the beam width can be widened, a thick tomographic image of a large-sized subject can be obtained.

In order to keep an X-ray transmitted image as a record, or to compare many types of photographs at once, a hard copy is absolutely necessary. In the apparatus that stores an X-ray transmitted image as electronic data, the stored data is monitored mainly by a display device such as a CRT. For this purpose, a separate device is required to obtain a hard copy of the electronic data stored in the memory. In this case, a degradation in image quality inevitably occurs due to a reading system for the hard copy.

The systems disclosed in the drawings following FIG. 9, which will be described hereinbelow, meet the requirements described above, and provide a radiation pickup device with which a hard copy of an X-ray transmitted image can be easily obtained. Since a hard copy of an X-ray transmitted image can be obtained within a very short period of time, such a radiation pickup device is effective in weld inspection of a large structure or management of mass-production articles that require early determination and recording. It is also apparent that the latent image transcribed onto the dielectric recording sheet can be detected as time-seial electrical signals by mechanical scanning by a potential difference measurement device, in place of developing it with a coloring agent.

A radiation pickup device, with which a hard copy of an X-ray transmitted image can be easily obtained, will be described in detail with reference to FIG. 9. More specifically, a radiation pickup device 120 has a box-like casing 122. An X-ray incident window member (not shown) is formed on the front surface of the casing 122. A coloring developing unit 124 is arranged in the casing 122. The coloring developing unit 124 can be a dry type that uses a powder toner, or a humid type that uses a liquid toner. Either type of coloring developing unit can be used. Either coloring developing unit 124 comprises a toner applicator 124A and a heater 124B. An imaging plate 126 is arranged in the casing 122 to oppose the X-ray incident window member. The imaging plate 126 can pick up an X-ray transmitted image and form a latent image. First and second rollers 128 and 130 are arranged in the casing 122. The detailed structure of the imaging plate 126 will be described later.

A charger 132 is arranged at a predetermined gap to the imaging plate 126 to be horizontally movable. A predetermined voltage is applied to the charger 132 by a power supply 132A. The charger 132 can uniformly charge the surface of the image plate 126 at a high potential. A dielectric recording sheet 134 held by a frame 134A is arranged in the vicinity of the casing 122, so that it can be loaded into and unloaded from the casing 122.

A transcript roller 136 is arranged in the vicinity of the second roller 130 in the casing 122. The transcript roller 136 is horizontally moved, as shown in FIG. 11D, to bring the recording sheet 134 into tight contact with the imaging plate 126. Then, a latent image formed on the imaging plate 126 is transcribed onto the recording sheet 134. The recording sheet 134 loaded and unloaded by the first and second rollers 128 and 130.

The radiation pickup device 120 will be described in more detail. More specifically, prior to developing, the charger 132 is driven to scan the imaging plate 126 at a small gap of about 5 mm to it along guides (not shown). As a result, the entire surface of the imaging plate 126 is charged to about 500 V. When the dielectric recording sheet 134 is inserted through an insertion port formed on a side of the casing 122, it is sandwiched by the rollers 128 and 130 and conveyed onto the imaging plate 126. When the recording sheet 134 reaches a portion above the imaging plate 126, the transcript roller 136 is driven along guides (not shown) to urge the recording sheet 134 against the imaging plate 126.

After being urged against the imaging plate 126, the recording sheet 134 is fed backward by the rollers 128 and 130. At this time, the latent image on the recording sheet 134 passes over the coloring developing unit 124. The toner attaches to the latent image in an amount proportional to the potential of the latent image. The toner is then fixed by the heater 124B, thus completing development.

Figure 10:
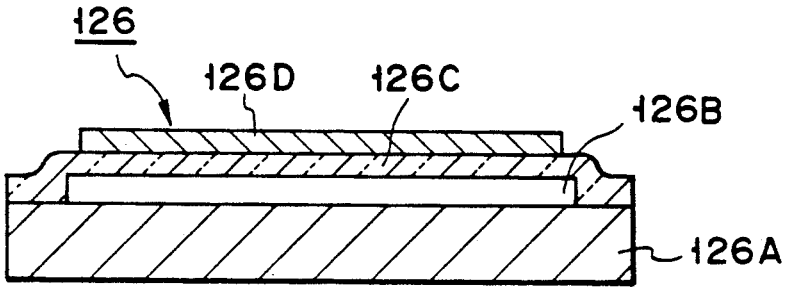
FIG. 10 is a sectional view of an imaging plate.

The imaging plate 126 used in the present invention will be understood by referring to FIG. 10 showing its enlarged sectional view. More specifically, the imaging plate 126 is obtained by sequentially forming a fluorescent layer 126B, an ITOC 126C, and a photosensitive layer 126D on an aluminum substrate 126A.

The fluorescent layer 126B contains an element, e.g., gadolinium, iodine, or cesium. A typical example of the fluorescent layer 126B is a $Gd_2O_2SiTb$ layer having a thickness of about 200 μm. The fluorescent layer 126B using gadolinium exhibits light emission having a peak at a wavelength of 550 nm upon being irradiated with an X-ray beam. Accordingly, the fluorescent layer 126B using gadolinium has a very high light-emitting efficiency. The photosensitive layer 126D is made of an inorganic or organic material. A typical example of the photosensitive layer 126D is an amorphous Si layer having a thickness of about 20 μm. The amorphous Si layer (photosensitive layer 126D) has a high sensitivity in a visible range and exhibits a quantization efficiency of substantially 100% with respect to light having a wavelength of about 550 nm.

The operation of the device 120 shown in FIG. 9 of obtaining a hard copy of an X-ray transmitted image will be described with reference to FIGS. 11A to 11E. FIGS. 11A to 11E show the operation of the device 120 shown in FIG. 9 with the elapse of time.

Figure 11A:
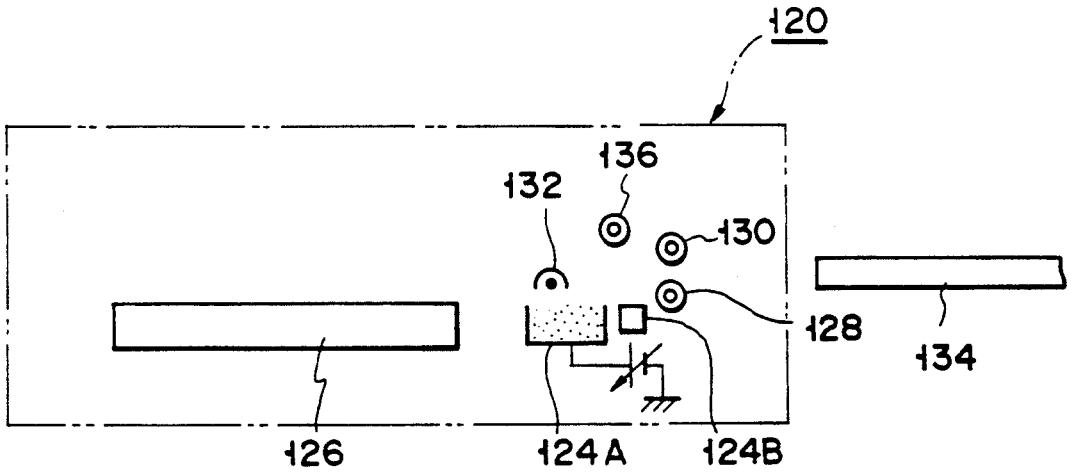
FIGS. 11A to 11E are views for explaining the steps of obtaining a radiation transmitted image and its hard copy with the system shown in FIG. 9.
Figure 11B:
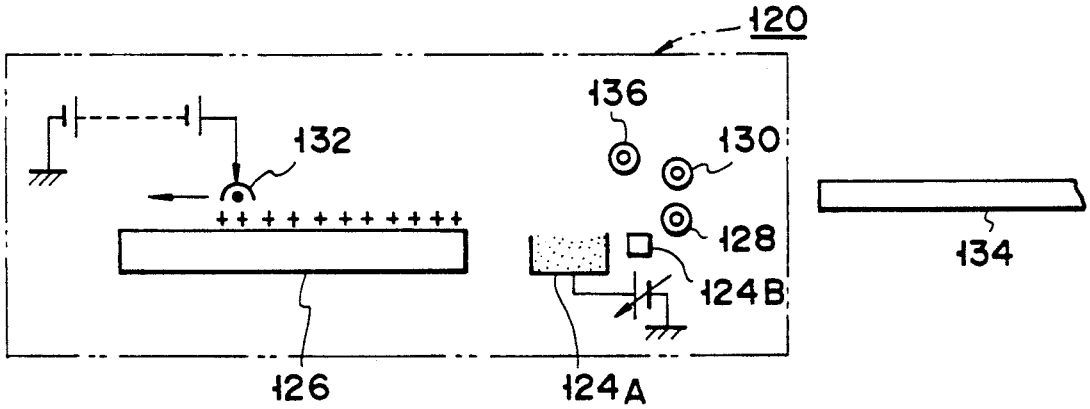

FIG. 11A shows the positional relationship among the respective portions of the device 120 before start of image pickup. The image pickup operation is started when the charger 132 is turned on by a start switch (not shown) to scan the imaging plate 126, as shown in FIG. 11B. A high voltage of 4 to 7 kV is applied to the imaging plate 126 by the charger 132, and the imaging plate 126 is thus uniformly charged to about 500 V, as described previously. This is the initialization of the imaging plate 126.

Figure 11C:
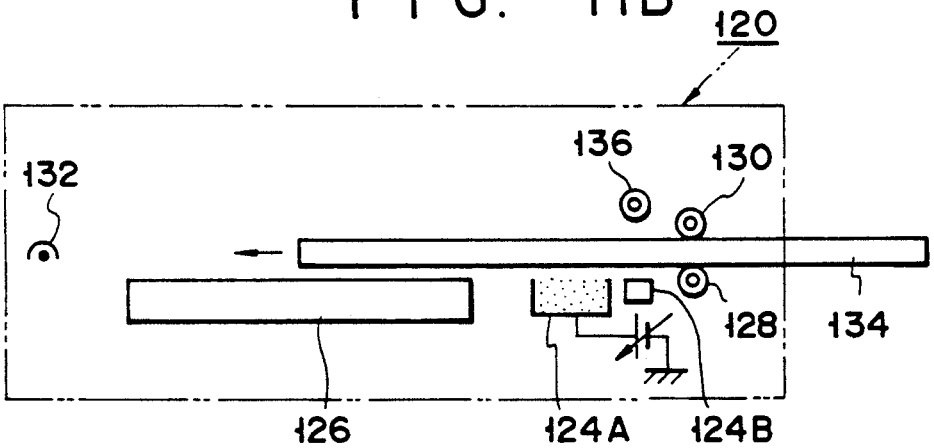
Figure 11D:
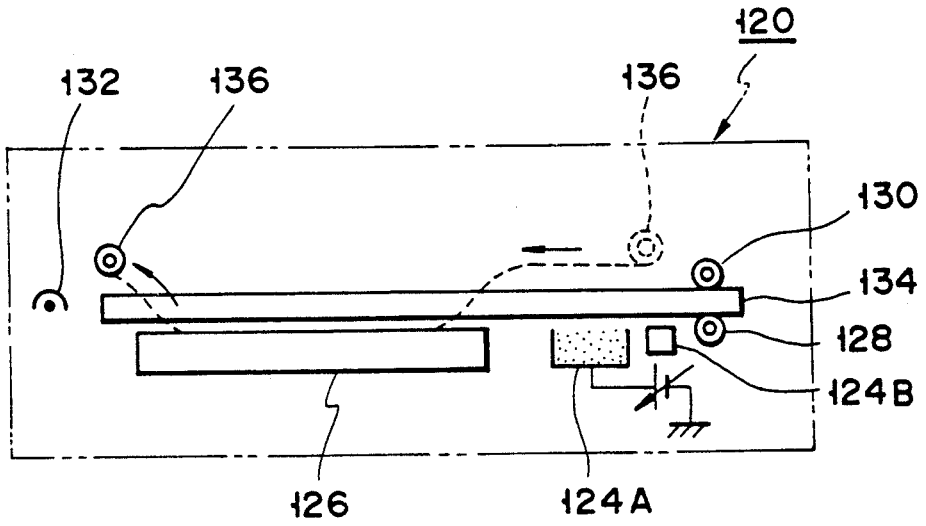

Then, the dielectric recording sheet 134 is inserted in the casing 122, as shown in FIG. 11C. The dielectric recording sheet 134 is set to oppose the imaging plate 126 at a gap of about 1 to 2 mm.

An X-ray transmitted image reaches the imaging plate 126 on its substrate side. The X-ray irradiation condition is 70 keV and about 10 mrym when, e.g., a fluoroscopic image of a human body is to be obtained. Then, a latent image is formed on the imaging plate 126. More specifically, upon X-ray irradiation, the gadolinium fluorescent layer 126B emits a visible light beam. Then, charges on portions of the amorphous Si layer 126D that are irradiated with the visible light beam are discharged onto the aluminum substrate 126A in accordance with the light emission, and a potential pattern of 500 to 50 V is formed in accordance with the X-ray transmitted image.

Figure 11E:
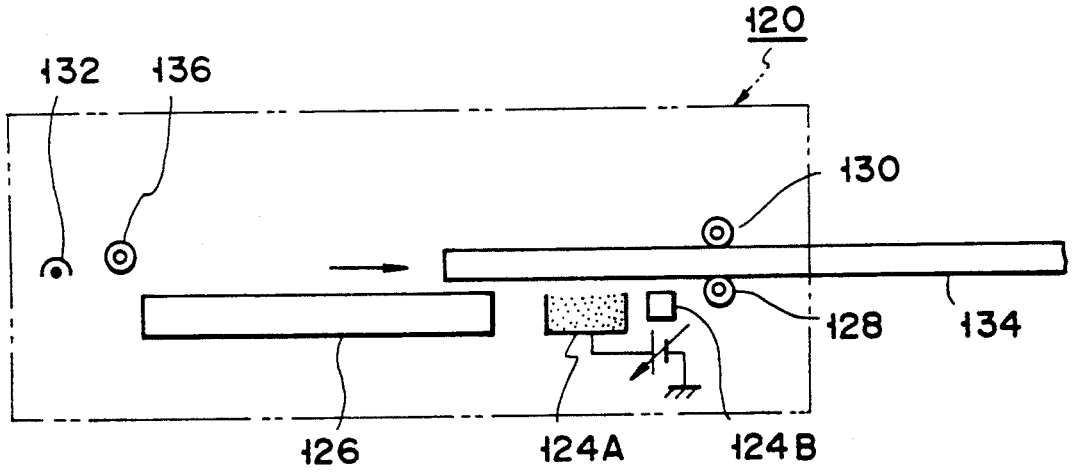

Subsequently, the transcript roller 136 is driven to scan along the guides (not shown), as shown in FIG. 11D, and the dielectric recording sheet 134 is urged against the surface of the imaging plate 126. Thus, the latent image on the imaging plate 126 is transcribed onto the dielectric recording sheet 134. The dielectric recording sheet 134, on which the latent image is transcribed, is driven to outside the casing 122 by the rollers 128 and 130, as shown in FIG. 11E. At this time, when the recording sheet 134 passes over the coloring developing unit 124A and the heater 124B, a toner attaches to the latent image and is fixed by the heater 124B, thereby completing development. An X-ray transmitted image hard copy is obtained in this manner by utilizing the recording sheet 134.

The dielectric recording sheet 134 passes over the developing unit 124 twice during the steps of FIGS. 11C and 11E. In the step of FIG. 11C, the developing agent does not attach to the latent image as no potential is formed on the dielectric recording sheet 134 by the latent image. However, for the purpose of development switching and adjustment of the development state, a voltage is externally supplied to the developing unit 124, thereby achieving optimum control. The dielectric recording sheet 134, on which the latent image is transcribed, is supplied to an image reading means, e.g., a surface potential measurement device shown in FIGS. 3 and 4, and an image is obtained in the form of electrical signals. This image is then displayed.

According to the present invention, a life-size X-ray transmitted image can be recorded instantaneously by using an imaging plate and a recording sheet. Also, an X-ray transmitted image hard copy can be easily obtained by using either a dry type or humid type coloring developing unit, and a recording sheet. Therefore, a weld portion of a large-sized structure can be quickly inspected, and quality control of mass-production articles can be effectively performed.

In this case, the hard copy of the X-ray transmitted image can be easily obtained, using a general Plane Paper copying (PPC) technique.

When a hard copy of an X-ray transmitted image is obtained by using the dry type or humid type coloring developing unit described above, a small amount of toner attaches to a portion of the hard copy, through which a large amount of X-ray beams have been transmitted, and this portion turns white. In contrast to this, a large amount of toner attaches to a portion of the hard copy, through which a small amount of X-ray beams have been transmitted, and this portion turns substantially black. This means that this hard copy cannot express a halftone image. A portion of a subject having a low X-ray transmittance is expressed as a black portion, and its detailed structure cannot be obtained. Such an inconvenience cannot be solved only by increasing the X-ray dose. This is because if the X-ray dose is increased over a certain amount, a portion, which was previously expressed in black in a hard copy, may abruptly turn white.

Figure 12:
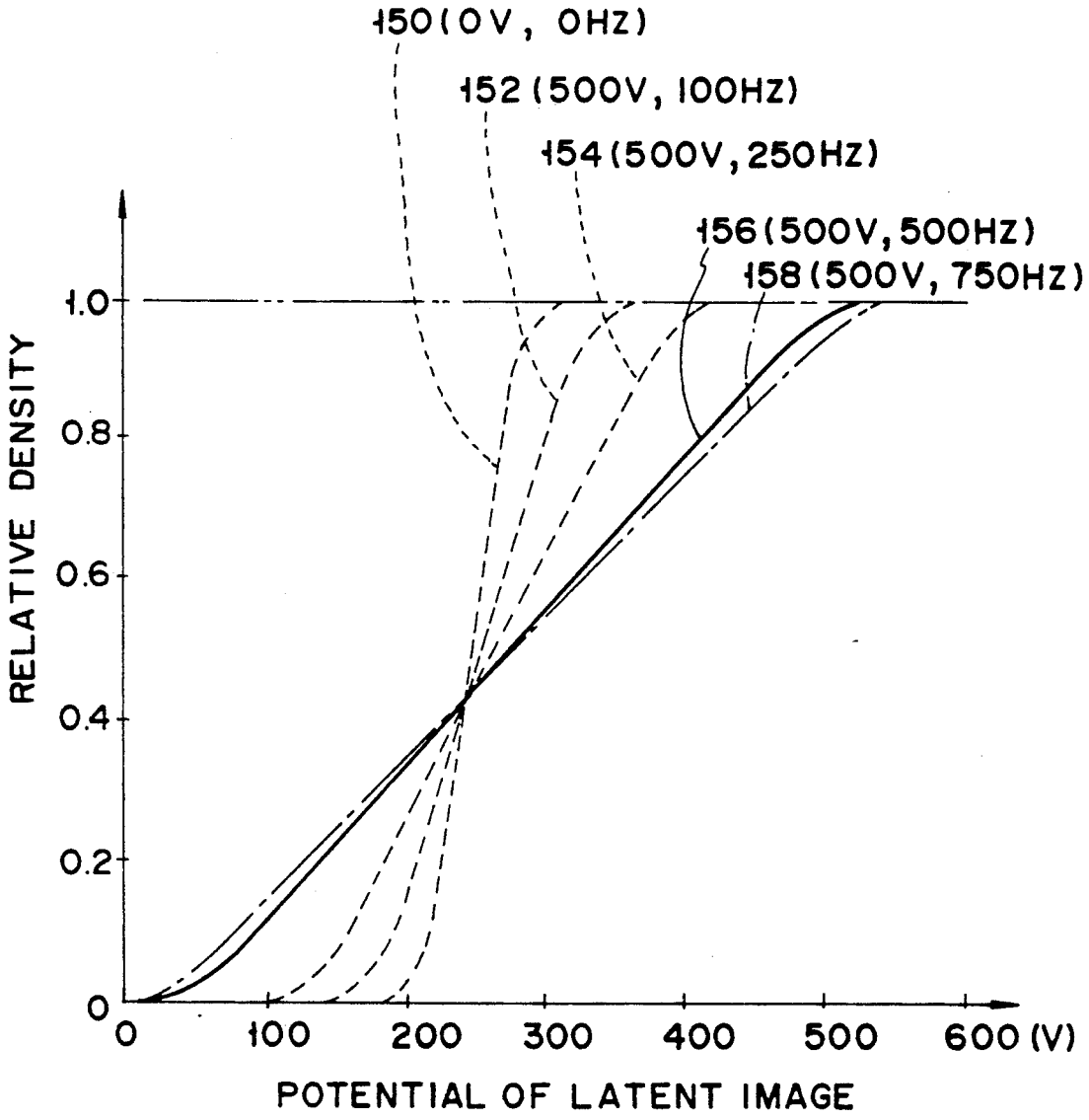
FIG. 12 is a graph showing the relationship among a voltage and a frequency supplied to a developing unit and an image relative density.

Hence, in order to solve this inconvenience, the present inventor conducted an experiment and obtained the results shown in FIG. 12. This experiment was performed to establish a technique to reproduce a halftone image and a reversal developing method.

First, the technique of reproducing a halftone image will be discussed. The image storage medium used in this experiment is the imaging plate 126 shown in FIGS. 9 and 10. The imaging belt 26 shown in FIGS. 1 and 2 may also be used instead. The charger and the recording sheet shown in FIGS. 9 and 1 were used. In this experiment, the relationship between the latent image potential and the relative density of the image was studied by changing the AC voltage and the frequency of the current supplied to the developing unit 124. A latent image (potential distribution) on the imaging plate 126 is generally at a negative potential. The amount of attached toner is proportional to the absolute potential. Accordingly, it should be understood that the potential scale in FIG. 12 represents absolute values, and that individual potentials are actually negative values.

As shown in FIG. 12, when an AC voltage is not applied to the charger, the toner does not attach at all until the latent image potential reaches 200 V. When the latent image potential exceeds 200 V, the toner starts to attach. The toner is saturated when the latent image potential is 300 V (curve 150).

In contrast to this, when an AC voltage having a peak value of 500 V is applied to the charger, the toner attaches in a halftone pattern in an amount proportional to the frequency. When the frequency of the applied AC voltage exceeds 500 Hz, the toner attachment subsides. For example, if the AC voltage has a frequency of 500 Hz, the toner starts to attach when the latent image potential is 50 V. The attached toner density is increased in proportion to the potential, and saturation does not start until the latent image potential exceeds 500 V. In other words, while the voltage supplied to the charger is between 50 V and 200 V, the attached toner density varies in proportion to the change in latent image potential (curves 152 to 158). This means that a hard copy expressing a halftone image can be obtained.

The technique of the reversal developing method will be described. With the toner developing method using the imaging plate and the recording sheet shown in FIGS. 9 and 11A to 11E, the imaging plate is charged to a negative high potential (−800 V) before photographing, and the uniform potential is discharged in accordance with an X-ray dose. Therefore, the surface potential of a portion of the imaging plate corresponding to a portion of a subject that has a higher X-ray transmittance is discharged more. Accordingly, the surface potential of a portion of the imaging plate corresponding to a portion of the subject that has a lower X-ray transmittance is not discharged. When this latter portion is developed using a toner, its details are surrounded by a black background, and such a hard copy is very difficult to see.

The purpose of the toner developing method employed by a general copy machine is not to correctly reproduce a halftone portion of an image, but to reproduce a line of a character or figure as clearly as possible. The illumination for a subject to be copied can be adjusted by an operator as desired in order to optimize the toner attaching state. In other words, the conditions required of a hard copy of an X-ray transmitted image are contrary to the purpose of the developing method of the conventional copy machine.

The lower the X-ray transmittance of a subject, the less the potential drop on the corresponding portion of the imaging plate, and the more the toner amount attaching to the imaging plate. In contrast to this, if it is designed such that the less the potential drop, the smaller the toner attaching amount, then a complicated portion of a subject having a low radiation transmittance will be reproduced in a clear, bright background. The resulting hard copy is very easy to see. Such a developing method is the reversal developing method.

The reversal developing method can be easily realized by utilizing a relative relationship between the surface potential of an imaging plate and the potential difference in a toner developing unit. For example, assume that the imaging plate has a saturated surface potential of −800 V (substrate or ground potential). In this case, if the toner developing unit is set at the ground potential, the toner does not attach to a portion of the imaging plate of which the surface potential is decreased, and if the surface potential is saturated, the toner attaches well, which means an ordinary developing method.

In contrast to this, assume that the toner developing unit is set at a voltage higher than −800 V. Then, the less the surface potential, the more the toner attaches to a corresponding portion, and the toner does not attach to a portion of which the surface potential is nearly saturated, which means that the reversal developing method is performed.

A hard copy obtained by the reversal developing method according to the present invention is very easy to see. This is because a portion of a subject which has a lower X-ray transmittance and which is more complicated is reproduced with a brighter background in the hard copy. This is completely contrary to a hard copy of an X-ray transmitted image obtained by the conventional toner developing method.

According to the present invention, the toner attaching amount linearly changes in accordance with the surface potential ranging from a potential at which the toner starts to attach and up to a potential at which the image density is saturated. Therefore, the gradation of the image is correctly reproduced.

Originally, a higher sensitivity than in conventional X-ray image pickup using an X-ray film is a characteristic feature of X-ray image pickup of the imaging plate scheme. When the reversal developing method of the present invention and so on is applied to this X-ray image pickup of the imaging plate scheme, the image recognition limit is further widened, leading to a decrease in X-ray transmitting amount.

FIGS. 13A to 13F show the steps of a high-sensitivity developing method of the present invention. As shown in FIG. 13A, first, an imaging plate 126 (26) is charged to have a surface potential of −800 V by a charger 132 (32) (refer to FIG. 13B).

Subsequently, a subject 300 is irradiated with an X-ray beam, as shown in FIG. 13C. An X-ray transmitted image reaches the imaging plate 126 (26). The surface potential of the photosensitive layer is discharged in accordance with the X-ray transmitting amount of the subject, and a potential latent image is formed. Thereafter, the substrate of the imaging plate 126 (26) is kept at a positive potential of +800 V, as shown in FIG. 13D. Accordingly, a portion of the photosensitive material of the imaging plate 126 (26) which is discharged upon X-ray irradiation has a higher positive potential.

A toner developing unit 124A, to which an AC voltage of 0 to +800 V and 500 Hz is applied, scans the latent image surface of the imaging plate 126 (26), as shown in FIG. 13E, and causes the toner to attach to the latent image, thereby performing coloring development. With this method, even a complicated portion of a subject having a low X-ray transmittance can be clearly developed.

In the following step, the toner image is transcribed onto a dielectric recording sheet 134 (34) to complete a hard copy, as shown in FIG. 13F. At this time, when a side of the dielectric recording sheet 134 (34) opposite to that facing the imaging plate 126 (26) is scanned by the charger 132 (32) to charge this side with a high-voltage static electricity, the toner image can be efficiently attached to the recording sheet 134 (34).

Figure 9:
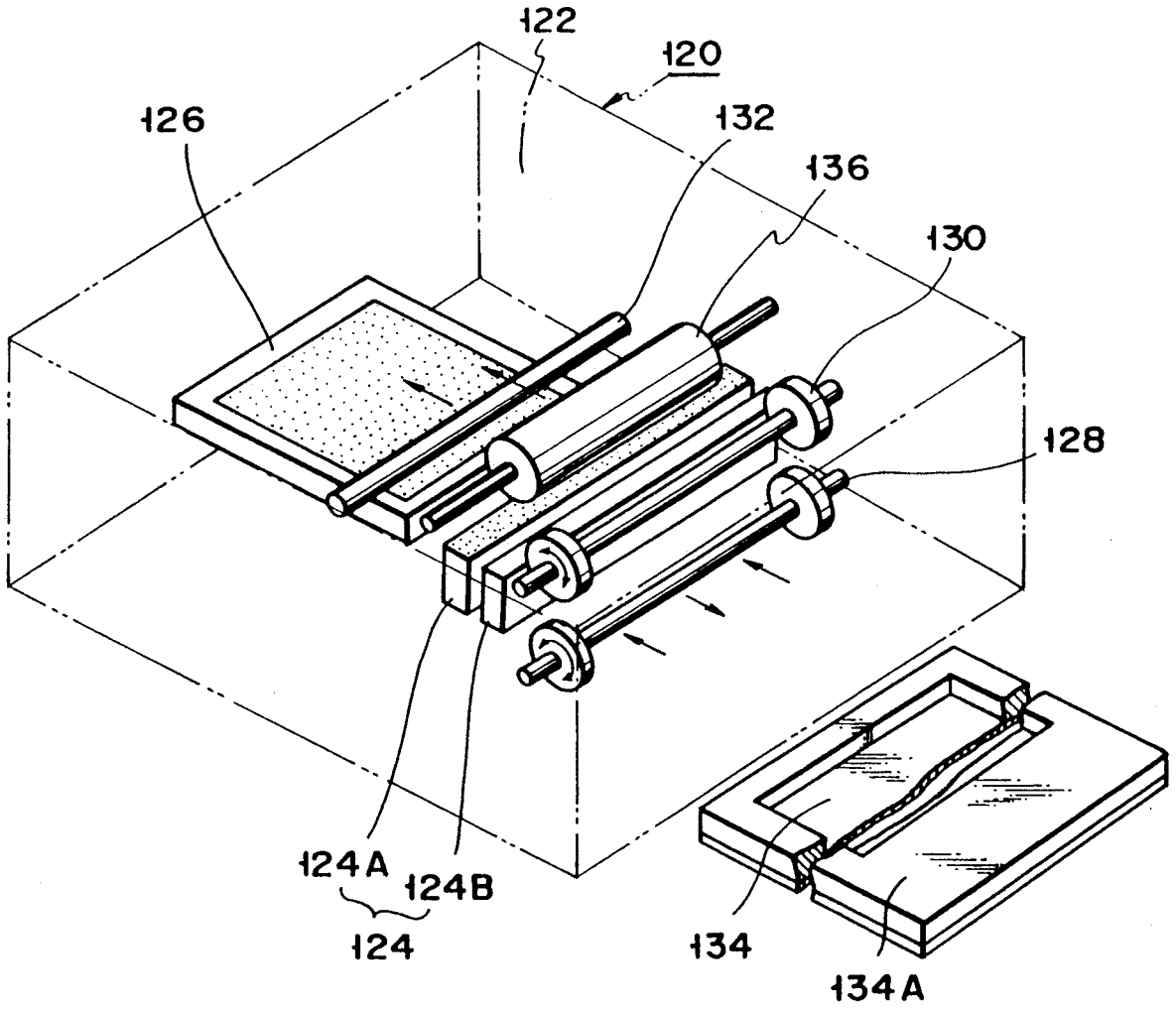
FIG. 9 is a schematic perspective view showing a system for easily obtaining a hard copy of a radiation transmitted image.
Figure 14:
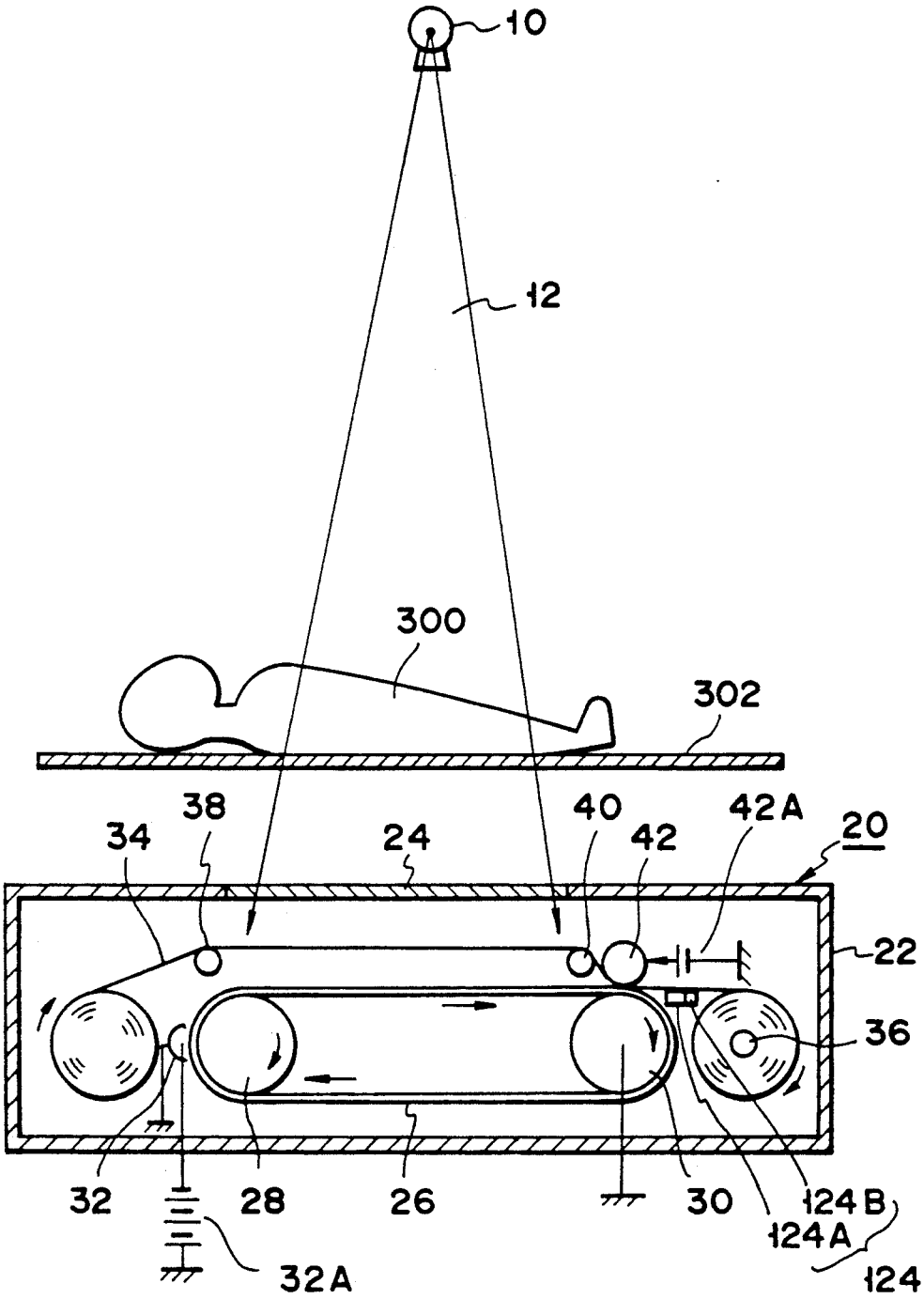
FIG. 14 shows a radiation photographing apparatus as a radiation imaging system capable of obtaining a radiation transmitted image and its hard copy.
Figure 15:
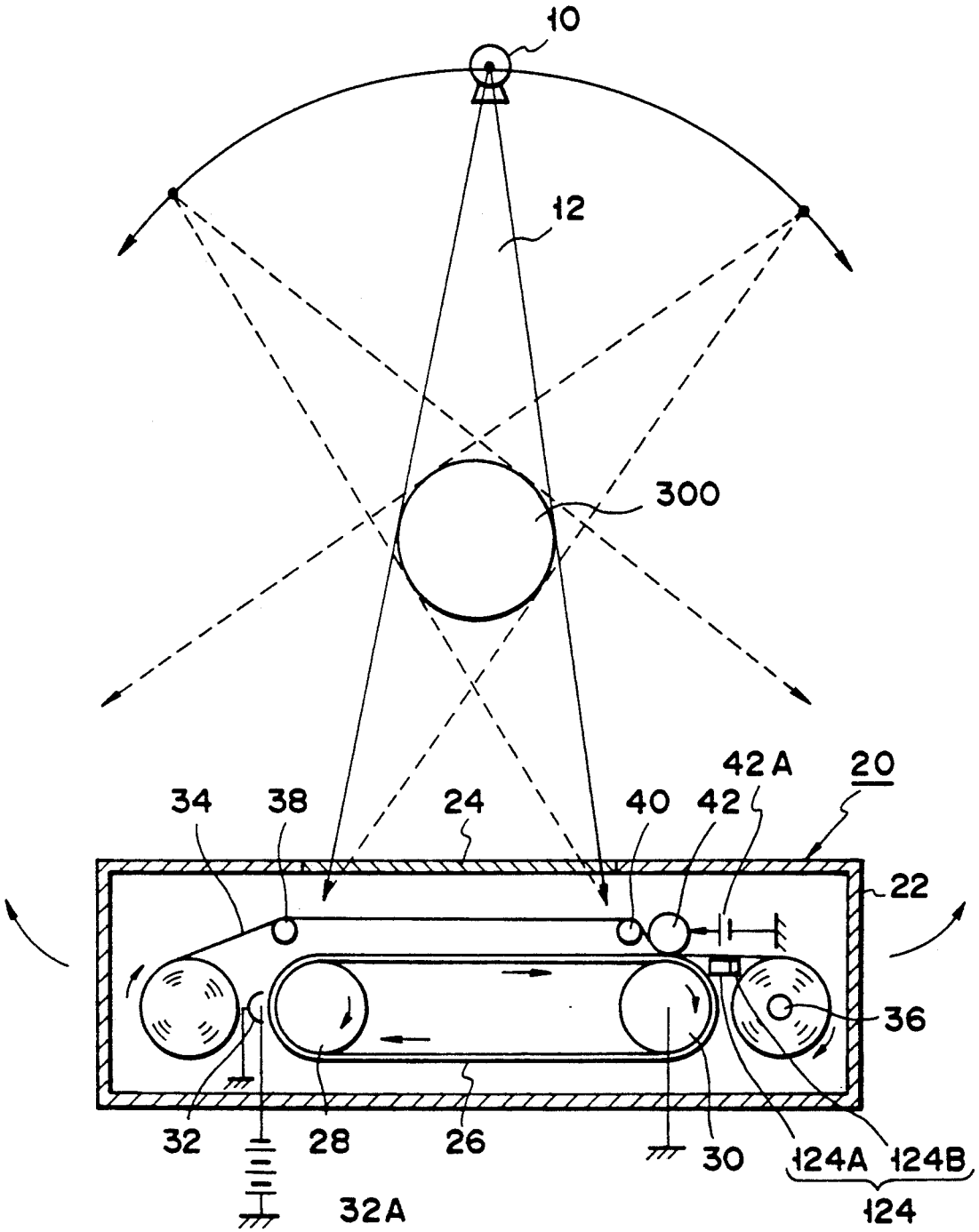
FIG. 15 shows a tomographic image photographing apparatus as a radiation imaging system capable of obtaining a radiation transmitted image and its hard copy.

The technique for easily obtaining a hard copy and the technique for easily obtaining a hard copy having a halftone image by using a reversal developing method, both of which are described above, are applicable not only to the system shown in FIG. 9 but also to the systems shown in FIGS. 1 and 7. FIG. 14 shows a case in which they are applied to the system shown in FIG. 1. FIG. 15 shows a case in which they are applied to the system shown in FIG. 7.

Referring to FIGS. 14 and 15, a toner applicator 124A and a heater 124B are provided in a casing 22. The toner applicator 124A and the heater 124B constitute a developing unit 124. The developing unit 124 can be considered to be identical with that shown in FIG. 9, and also with that shown in FIGS. 13A to 13F. A variable-voltage, variable-frequency power supply is connected to the developing unit 124 shown in FIGS. 13A to 13F. Preferably, an AC voltage of 800 V and 500 Hz is supplied to the developing unit 124 shown in FIGS. 13A to 13F.

Additional advantages and modifications will readily occur to those skilled in the art. Therefore, the invention in its broader aspects is not limited to the specific details, representative devices, and illustrated examples shown and described herein. Accordingly, various modifications may be without departing from the spirit or scope of the general inventive concept as defined by the appended claims and their equivalents.

What is claimed is:

1. A radiation pickup device comprising:

a casing having a radiation incident window formed therein;

first and second rollers arranged in said casing on two sides of said radiation incident window, respectively;

an endless belt-like imaging belt comprising a fluorescent layer which is sensitive to a directly received radiation to emit light, a photosensitive layer which is sensitive to light emitted by said fluorescent layer, and a flexible substrate on which said fluorescent layer and said photosensitive layer are formed, wherein said fluorescent layer, said photosensitive layer and said flexible substrate form said imaging belt in a one-piece body structure;

a charger, arranged in the casing on said first roller side, for uniformly charging said photosensitive layer of said imaging belt;

a rolled dielectric recording sheet, removably arranged in said casing, for transcribing the latent image formed on said photosensitive layer of said imaging belt;

a transcript roller which presses an extracted portion of said dielectric recording sheet against said second roller together with said imaging belt, thereby transcribing the latent image formed on said imaging belt onto said dielectric recording sheet; and a takeup roller for taking up a portion of said dielectric recording sheet on which the latent image is transcribed by being passed between said transcript roller and said second roller.

2. A device according to claim 1, wherein said fluorescent layer comprises a $Gd_2O_2SiTb$ layer having a thickness of 200 μm.

3. A device according to claim 1, wherein said photosensitive layer comprises an amorphous Si layer having a thickness of 20 μm.

4. A device according to claim 1, wherein said radiation incident window is made of a radiation transmitting material.

5. A device according to claim 1, wherein said endless belt-like imaging belt further comprises a light-reflecting layer which reflects light emitted by said fluorescent layer to said photosensitive layer.

6. A device according to claim 1, wherein said endless belt-like imaging belt further comprises a transparent conductive layer on said photosensitive layer.

7. A radiation imaging system including:

a radiation pickup device comprising;

a casing having a radiation incident window formed therein, first and second rollers arranged in said casing on two sides of said radiation incident window, respectively, an endless belt-like imaging belt, which is obtained by forming a fluorescent layer, that is sensitive to a radiation to emit light, and a photosensitive layer sensitive to light emitted by said fluorescent layer, on a flexible substrate, and which is looped around said first and second rollers to be driven thereby, for forming a latent image corresponding to a radiation transmitted image, a charger, arranged in said casing on said first roller side, for uniformly charging said photosensitive layer of said imaging belt, a rolled dielectric recording sheet, removably arranged in said casing, for transcribing the latent image formed on said photosensitive layer of said imaging belt, a transcript roller which presses an extracted portion of said dielectric recording sheet against said second roller together with said imaging belt, thereby transcribing the latent image formed on said imaging belt onto said dielectric recording sheet, and a takeup roller for taking up a portion of said dielectric recording sheet on which the latent image is transcribed by being passed between said transcript roller and said second roller;

radiation generating means for generating a radiation toward said radiation incident window of said radiation pickup device; and image reading means for scanning the latent image on said dielectric recording sheet by a probe while rewinding said dielectric recording sheet, taken up by said takeup roller, to another takeup roller, converting the latent image into an electrical signal, and reading the electrical signal.

8. A system according to claim 7, further including display means for displaying the image data read by said image reading means as a radiographic image.

9. A system according to claim 7, further including reconstructing means for reconstructing the image data read by said image reading means, so as to obtain a tomographic image, and display means for displaying the tomographic image.

10. A system according to claim 7, wherein said image reading means comprises a surface potential difference measurement device.

11. A system according to claim 5, further including display means for displaying the image data read by said image reading means as a fluoroscopic image.

12. A radiation imaging system including:

a radiation pickup device comprising;

a casing having a radiation incident window formed therein, first and second rollers arranged in said casing on two sides of said radiation incident window, respectively, an endless belt-like imaging belt, which is obtained by forming a fluorescent layer, that is sensitive to a radiation to emit light, and a photosensitive layer sensitive to light emitted by said fluorescent layer, on a flexible substrate, and which is looped around said first and second rollers to be driven thereby, for forming a latent image corresponding to a radiation transmitted image, a charger, arranged in said casing on said first roller side, for uniformly charging said photosensitive layer of said imaging belt, a rolled dielectric recording sheet, removably arranged in said casing, for transcribing the latent image formed on said photosensitive layer of said imaging belt, a transcript roller which presses an extracted portion of said dielectric recording sheet against said second roller together with said imaging belt, thereby transcribing the latent image formed on said imaging belt onto said dielectric recording sheet, and a takeup roller for taking up a portion of said dielectric recording sheet on which the latent image is transcribed by being passed between said transcript roller and said second roller;

radiation generating means for generating a radiation toward said radiation incident window of said radiation pickup device;

image reading means for scanning the latent image on said dielectric recording sheet by a probe while rewinding said dielectric recording sheet, taken up by said takeup roller, to another takeup roller, converting the latent image into an electrical signal, and reading the electrical signal; and developing means for developing the latent image on said dielectric recording sheet with a coloring developing agent.

13. A system according to claim 12, further including display means for displaying the image data read by said image reading means as a radiographic image.

14. A system according to claim 12, further including reconstructing means for reconstructing the image data read by said image reading means, so as to obtain a tomographic image, and display means for displaying the tomographic image.

15. A system according to claim 12, wherein said developing means comprises a toner applicator using a powder toner and a heater.

16. A system according to claim 12, wherein said developing means comprises a toner applicator using a liquid toner and a heater.

17. A system according to claim 15 or 16, wherein a voltage of not less than several 10 V having a frequency of not less than several Hz is supplied to said toner applicator.

18. A system according to claim 12, wherein said image reading means comprises a surface potential difference measurement device.

19. A system according to claim 10, further including display means for displaying the image data read by said image reading means as a fluoroscopic image.

20. A radiation image system including:

a radiation pickup device comprising;

a casing having a radiation incident window formed therein, first and second rollers arranged in said casing on two sides of said radiation incident window, respectively, an endless belt-like imaging belt comprising a fluorescent layer which is sensitive to a directly received radiation to emit light, a photosensitive layer which is sensitive to light emitted by said fluorescent layer and a flexible substrate on which said fluorescent layer and said photosensitive layer are formed, wherein said fluorescent layer, said photosensitive layer and said flexible substrate form said imaging belt in a one-piece body structure, a charger, arranged in the casing on said first roller side, for uniformly charging said photosensitive layer of said imaging belt, a rolled dielectric recording sheet, removably arranged in said casing, for transcribing the latent image formed on said photosensitive layer of said imaging belt, a transcript roller which presses an extracted portion of said dielectric recording sheet against said second roller together with said imaging belt, thereby transcribing the latent image formed on said imaging belt onto said dielectric recording sheet, and a takeup roller for taking up a portion of said dielectric recording sheet on which the latent image is transcribed by being passed between said transcript roller and said second roller;

radiation generating means for generating a radiation toward said radiation incident window of said radiation pickup device; and developing means for developing the latent image on said dielectric recording sheet with a coloring developing agent.

21. A system according to claim 20, wherein said developing means comprises a toner applicator using a liquid toner and a heater.

22. A system according to claim 20, wherein said endless belt-like imaging belt further comprises a light-reflecting layer which reflects light emitted by said fluorescent layer to said photosensitive layer.

23. A system according to claim 20, wherein said endless belt-like imaging belt further comprises a transparent conductive layer on said photosensitive layer.

24. A system according to claim 20, wherein said developing means comprises a toner applicator using a powder toner and a heater.

25. A system according to claim 24 or 21, wherein a voltage of not less than several 10 V having a frequency of not less than several Hz is supplied to said toner applicator.

26. A radiation imaging method for obtaining a hard copy of a radiation transmitted image by using an endless belt-like imaging belt, said endless belt-like imaging belt being employed to form a latent image corresponding to the radiation transmitted image and being obtained by forming a fluorescent layer which is sensitive to a directly received radiation to emit light, a photosensitive layer which is sensitive to light emitted by said fluorescent layer and a flexible substrate on which said fluorescent layer and said photosensitive layer are formed, wherein said fluorescent layer, said photosensitive layer and said flexible substrate form said imaging belt in a one-piece body structure, said method comprising the steps of:

charging a front surface of said image storage medium, to which the radiation transmitted image reaches, with a high voltage;

radiating the radiation transmitted image onto said front surface of said image storage medium in order to form the latent image thereon;

scanning said front surface of said image storage medium, on which the latent image is formed, with a toner developing unit to which an AC voltage is supplied; and scanning said front surface of said image storage medium with a charger by a high voltage, thereby reversely transcribing a toner image formed on said front surface of said image storage medium onto a sheet member.

27. A method according to claim 26, wherein said endless belt-like imaging belt further comprises a light-reflecting layer which reflects light emitted by said fluorescent layer to said photosensitive layer.

28. A method according to claim 26, wherein said endless belt-like imaging belt further comprises a transparent conductive layer formed on said photosensitive layer.

* * * * *